US005447583A

United States Patent [19]

Arthur et al.

[11] Patent Number: 5,447,583

[45] Date of Patent: Sep. 5, 1995

[54] EXTRUSION QUENCHING APPARATUS AND RELATED METHOD

[75] Inventors: William R. Arthur, Pittsburgh; Douglas T. Bozich, Verona; Richard B. Jacobus, New Kensington; Thomas J. Rodjom; Joseph R. Sikora, both of Murrysville, all of Pa.

[73] Assignee: Aluminum Company of America, Pittsburgh, Pa.

[21] Appl. No.: 73,545

[22] Filed: Jun. 9, 1993

Related U.S. Application Data

[62] Division of Ser. No. 875,863, Apr. 29, 1992, Pat. No. 5,284,327.

[51] Int. Cl.[6] ..... C22F 1/04

[52] U.S. Cl. ..... 148/689; 148/559; 148/579; 148/666; 148/714

[58] Field of Search ..... 148/689, 559, 714, 579, 148/666

[56] References Cited

U.S. PATENT DOCUMENTS

| | | | |
|---|---|---|---|
| 3,303,062 | 2/1967 | Clumpner et al. | 148/559 |
| 3,604,234 | 9/1971 | Hinrichsen et al. | 72/13 |
| 3,650,282 | 3/1972 | Hollyer et al. | 134/122 R |
| 3,698,700 | 10/1972 | Ziehm, Jr. et al. | 148/689 |
| 3,850,763 | 11/1974 | Zinnbauer et al. | 148/690 |
| 3,857,063 | 12/1974 | Major et al. | 315/170 |
| 3,874,213 | 4/1975 | Sperry et al. | 148/689 |
| 3,996,075 | 12/1976 | Furney et al. | 148/698 |
| 4,106,956 | 8/1978 | Bercovici | 148/690 |

FOREIGN PATENT DOCUMENTS

| | | |
|---|---|---|
| 1058109 | 7/1979 | Canada . |
| 1206354 | 6/1986 | Canada . |

OTHER PUBLICATIONS

Lankford, Jr. et al., "The Making, Shaping, and Treating of Steel", p. 1043, 6th para., Tenth Edition, 1985.

*Primary Examiner*—David A. Simmons
*Assistant Examiner*—Robert R. Koehler
*Attorney, Agent, or Firm*—Arnold B. Silverman; Thomas R. Trempus

[57] ABSTRACT

Apparatus for cooling a metal extrusion, such as an aluminum extrusion, may include a carriage which houses the cooling liquid delivery system and is relatively movable with respect to the extrusion press in order to provide the desired amount of air cooling prior to quenching. The quenching apparatus may have a plurality of generally parallel cooling liquid delivery tubes, each having a plurality of nozzles which are preferably independently adjustable as to volume and spray pattern. The cooling liquid delivery tubes may be axially rotated and flow of the cooling liquid within each tube may be independently adjusted. The housing of the quenching unit may have an upper portion which is rotatable generally upwardly and is provided with a transparent window to facilitate viewing of the spraying action. A method of quenching an aluminum extrusion employing such apparatus is provided.

10 Claims, 6 Drawing Sheets

EXTRUSION QUENCHING APPARATUS AND RELATED METHOD

This is a division of application Ser. No. 07/875,863, filed Apr. 29, 1992, now U.S. Pat. No. 5,284,327.

BACKGROUND OF THE INVENTION

1. Field of the Invention

This invention relates to a method and apparatus for cooling a metal extrusion, such as an aluminum extrusion and, more specifically, it relates to such a system wherein precise control of the spray pattern and amount of cooling liquid delivered is provided.

2. Description of the Prior Art

It has long been known to cool a metal workpiece by quenching, as by the use of air or water. See, generally, U.S. Pat. Nos. 3,996,075, 4,106,956 and Canadian Patents 1,058,109 and 1,206,354.

It has also been known to deliver cooling air or water by means of a spray or to quench such a metal workpiece by immersion of the workpiece in cooling water. See U.S. Pat. Nos. 3,850,763 and 3,874,213.

The use of a fixed array ring of water spray nozzles which direct water onto the periphery of a steel pipe having an elevated temperature is disclosed in The Making, Shaping and Heat Treating of Steel, page 1043, 10th Ed., 1985.

Despite the foregoing known systems, there remains a very real and substantial need for a quenching system for use with extrusions which will be adapted to provide highly efficient quenching even when products have irregular configurations and varying wall thicknesses.

SUMMARY OF THE INVENTION

The apparatus and method of the present invention have met the above described needs.

In a preferred form of the apparatus, the cooling liquid delivery means are housed within a carriage which is moveably positioned with respect the outlet end of an extrusion press so as to facilitate ambient air cooling to a desired temperature level prior to the extrusion's entry into the quench carriage.

The carriage housing contains a plurality of elongated cooling liquid delivery tubes which are disposed generally parallel to the path of travel of the extrusion. The tubes are preferably circumferentially generally uniformly spaced with respect to each other. The tubes contain a plurality of liquid delivery nozzles which are independently adjustable as to volume and pattern of flow. The pressure and volume of the total cooling liquid delivered to the tubes is monitored and controlled. The direction of nozzle discharge may be altered by axial rotation of the tubes. This system, therefore, permits delivery of a precisely determined pattern of cooling liquid to the extrusion in order to achieve the desired cooling thereof.

The upper housing portion is preferably movable with respect to the lower housing portion so as to facilitate easy access to the cooling tubes and nozzles for set up as well as maintenance and repair.

The method of the present invention employs apparatus of this general type and involves adjusting the water or other cooling liquid flow rate or pressure within the delivery tubes and the positions and degree of opening of the nozzles so as to achieve the desired range of cooling water impingement on the desired locations as the extrusion passes through the apparatus.

It is an object of the present invention to provide a system for efficient cooling of an extrusion in a manner which optimizes the delivery of cooling liquid to the desired portions of the extrusion to achieve proper solution heat treatment while minimizing undesired distortion of the extrusion.

It is another object of this invention to provide such a method and apparatus wherein prior to initiating operation of the quenching unit, it is positioned a desired predetermined distance from the discharge end of the extrusion press.

It is another object of the present invention to provide such a system which is a closed system that permits precise regulation of the flow pattern and flow rate in a manner customized to both the extrusion profile and the desired final shape.

It is a further object of the present invention to provide such a system which facilitates delivery of different volumes of cooling liquid to different portions of the extrusion to control the local cooling rates, It is a further object of the present invention to provide such a system which will efficiently quench extrusions which are solid or hollow and have uneven wall thicknesses when viewed in cross section.

It is another object of the present invention to provide such a system which permits either maintaining the extrusion's straight axial configuration or providing controlled deformation therein, as desired.

It is another object of the present invention to accomplish such cooling while employing a relatively low volume of cooling liquid and if desired heating or cooling the coolant fluid to maintain the desired coolant temperature.

It is another object of the present invention to provide such a system which is capable of cooling the extrusion without substantial alteration of its properties, if such action is desired.

These and other objects of the invention will be more fully understood from the following description of the invention on reference to the illustrations appended hereto.

DESCRIPTION OF THE PREFERRED EMBODIMENTS

Figure 1:
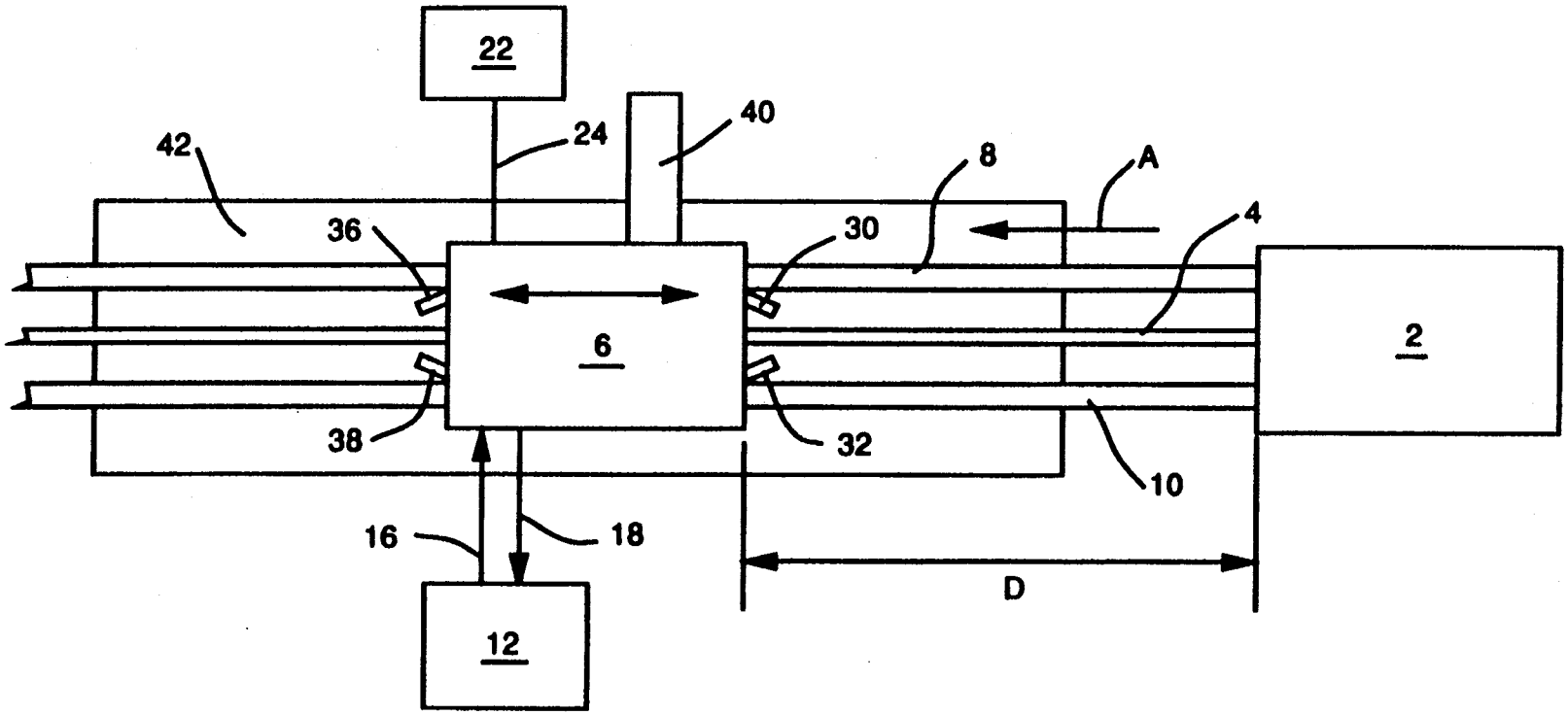
FIG. 1 is a schematic plan view of a form of apparatus of the present invention.

Referring in greater detail to FIG. 1, there is shown schematically an extrusion press 2 out of which is emerging an extrusion 4 which travels in the direction of arrow A. The quenching apparatus 6 is adapted for relative movement toward or away from the extrusion press 2 along spaced parallel tracks 8, 10.

A cooling liquid supply reservoir 12 supplies cooling liquid which will generally be water, through pipe 16 to the quenching unit 6 for delivery to the extrusion 4. Water collected within the quenching unit 6 is returned to the reservoir 12 through pipe 18. If desired, suitable filter means may be provided to removed undesired foreign material from the water returning to reservoir 12. Also, if desired, heating or cooling means may be employed to adjust the temperature of the cooling water to the desired level to control the degree of cooling.

If desired, known additives which provided for more uniform cooling may be added to cooling water. Among such additives are polymer glycol additives such as that sold under the trade designation Ucon A by Union Carbide. Another suitable additive is Parquench which is sold by Park Chemical.

Pressurized air supply means 22 which may convenient be a compressor, through pipe 24 supplies air at elevated pressure to air jet tubes 30, 32 which discharge the air onto the extrusion 4 as it approaches the quenching unit 6 so as to remove foreign matter therefrom. An additional pair of air jet tubes 41,44 (FIG. 4) may be positioned under tubes 30, 32 in order to provide a pair of tubes 30, 32 above the extrusion and a pair below. These tubes also serve to resist travel of cooling liquids along the extrusion toward the extrusion press. Similarly, air jet tubes 36, 38 serve to remove excess water from the extrusion as it emerges from quenching unit 6. A similar additional pair of air jet tubes (not shown in this view) positioned at lower level than the extrusion may be provided at the exit end of quench unit 6. If desired, additional air jet tubes may be positioned within the quench unit 6 intermediate the entry end and exit end.

A collection trough 42 receives water which drops off of the extrusion 4 or is removed by the air jets 30, 32, 36, 38. Suitable pump means (not shown) delivers fresh cooling water through pipe 16 to quench unit 6 and returns water to reservoir 12 through pipe 18.

Figure 2:
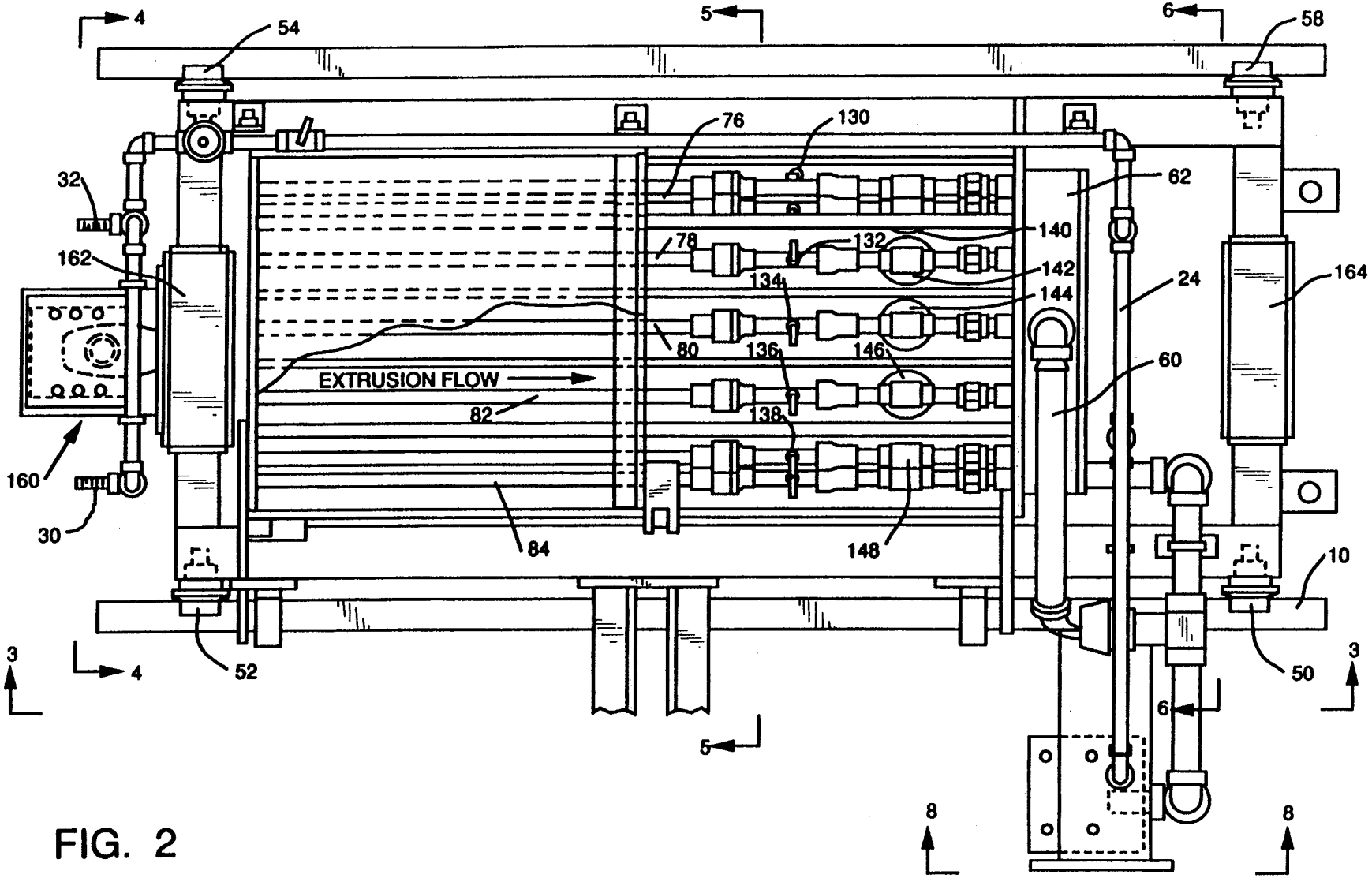
FIG. 2 is a top plan view of a form of apparatus of the present invention.
Figure 3:
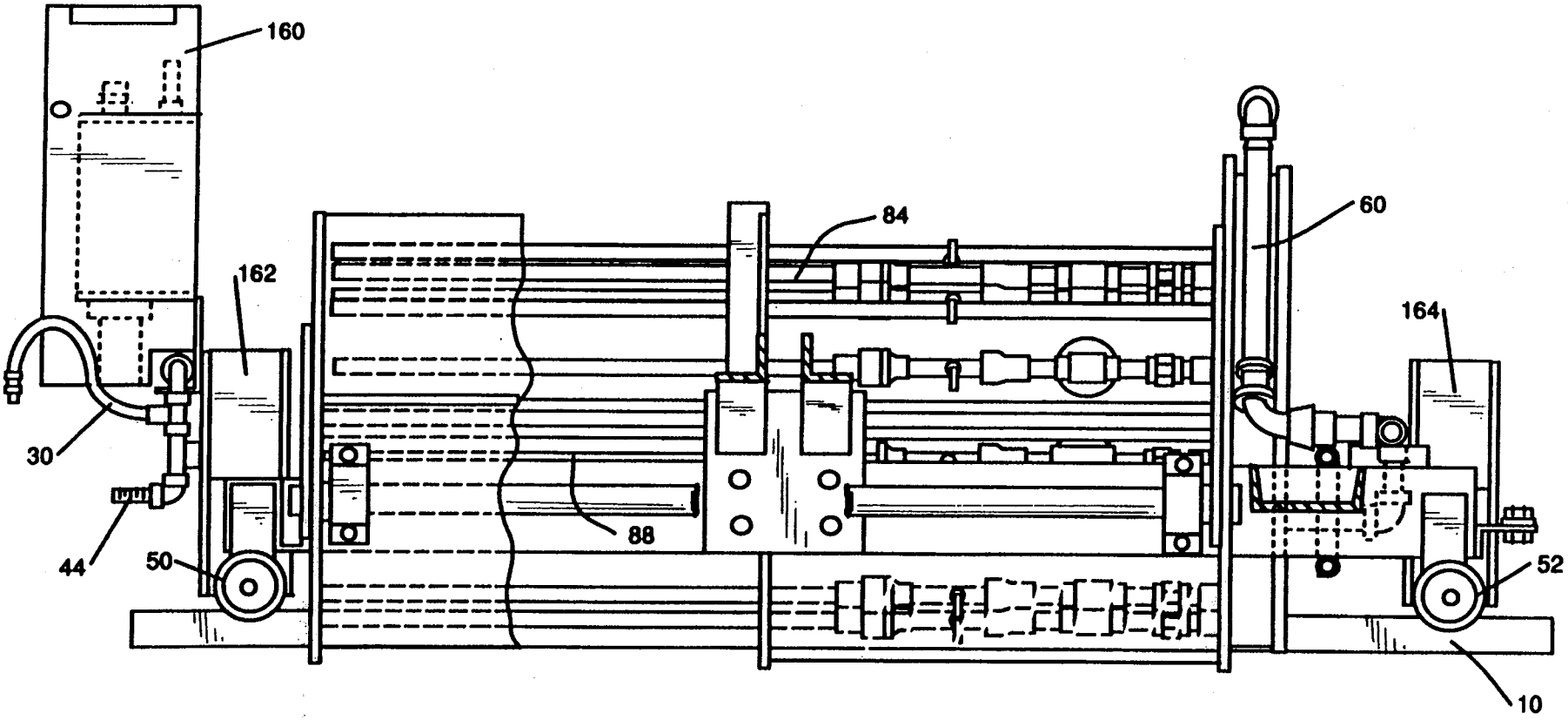
FIG. 3 is a cross-sectional elevational view of the apparatus of the present invention taken through 3—3 of FIG. 2.
Figure 4:
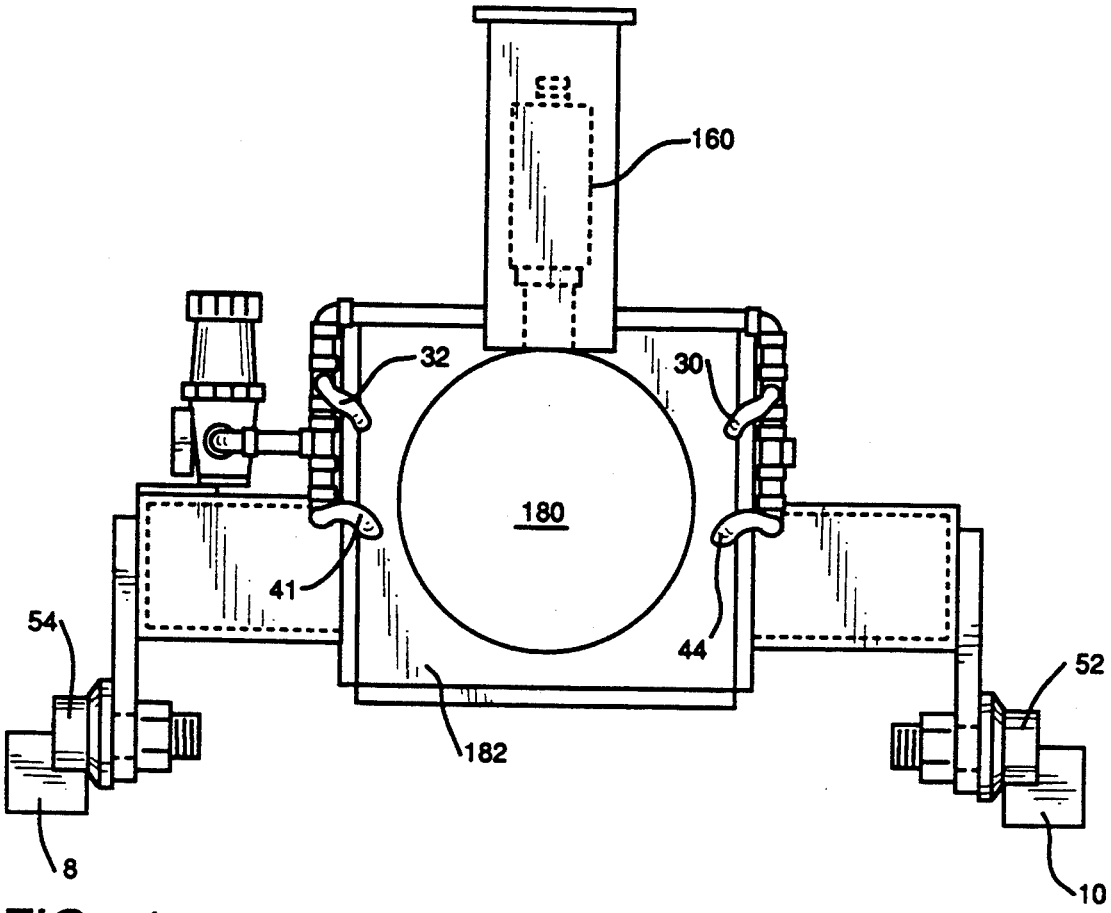
FIG. 4 is a cross-sectional illustration of the apparatus of FIG. 2 taken through 4—4.

Referring in greater detail to FIGS. 2 through 4, it will be seen that in the form shown, the carriage has four rotatable wheels 50, 52, 54, 58 which are flanged and in engagement with their respective tracks 8, 10. By means of a motor and ball screw (now shown in these views) the carriage may be moved toward or away from the extrusion press 2. The desired distance D (FIG. 1) between the entry end of the quench unit carriage and the discharge end of the extrusion press 2 is determined by the desired degree of air cooling which the extrusion 4 will experience before it enters the quench unit 6. In general, it will be desired that the extrusion entering the quench unit 6 will have been cooled to a temperature at or slightly above the extrusion materials' solvus temperature. For example, for an aluminum alloy of the 6xxx series this temperature will generally be about 900° F. As shown in FIG. 2, water is delivered to the system through water line 60 which is connected to header 62, which in turn communicates with the water delivery tubes which will be described in greater detail hereinafter.

Figure 5:
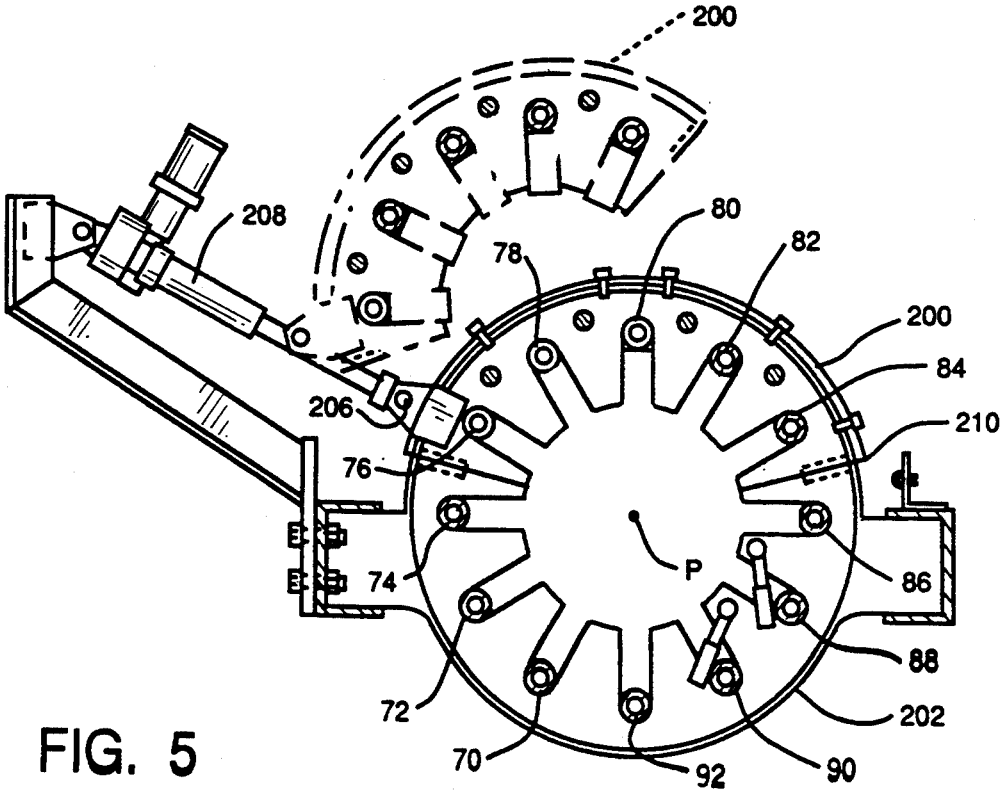
FIG. 5 is a cross-sectional illustration of the apparatus of FIG. 2 taken through 5—5.
Figure 7:
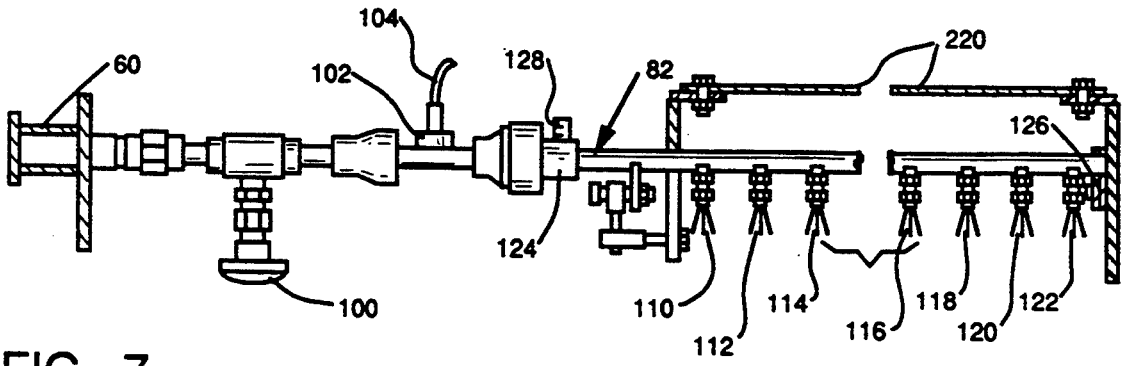
FIG. 7 is a cross-sectional illustration of the apparatus of FIG. 6 taken through 7—7.

Referring to FIGS. 5 and 7, it will be seen that the water is fed to a plurality of delivery tubes 70–92 (even numbers only) which are circumferentially generally equally spaced with respect to each other and also are generally equally spaced from the center of the path P on which the extrusion will pass in travelling through the quench unit 6.

A typical cooling liquid delivery tube 82 is shown in FIG. 7. Between the water supply header 60 and the tube is positioned a valve 100 which enables full shutoff of delivery of water or a reduction in water flow to that tube. In the preferred embodiment, each tube will have such a valve. The valves, while shown in FIG. 2 as being disposed within the quench unit carriage interior may be positioned exteriorly thereof for convenience of access, if desired. Also, while manually operable valves have been illustrated, if desired, automated remote control of the valves in a manner well known to those skilled in the art may be provided.

Also disposed on the tube is transducer 102 which will measure pressure in the water within the tube 82. The pressure reading will be delivered to a suitable control unit (not shown) by electrical lead 104. In this manner, it will be appreciated that the valve 100 and transducer 102 cooperate to respectively control the volume of flow within the tube 82 and provide feedback as to the pressure with the tube 82. If desired, automatic means known to those skilled in the art could be employed to adjust the flow rate responsive to such pressure reading.

The tube 82 preferably has a plurality of cooling liquid discharge nozzles 110, 112, 114, 116, 118, 120, 122 which discharge water contained in the tube 82 in a spray which impinges upon the extrusion 4 (not shown in this view). In the preferred form, each of the nozzles 110–122 (even numbers only) is individually adjustable so as to control the rate of flow and spray pattern of cooling liquid emerging therefrom. While in the broken away illustration in FIG. 7, seven nozzles have been shown, it will be appreciated that any desired number may be employed. As the path of movement of the extrusion as shown in FIG. 7 will be from right to left, the extrusion will be exposed to cooling liquid emerging from the nozzles sequentially. Not only can the individual nozzles 110–122 (even numbers only) be adjusted to alter the flow, but if desired different forms of nozzles providing different patterns of spray may be employed for particular installations. Also, nozzles having an axially asymmetrical discharge opening, such as a rectangular shape, for example, could be rotated axially to alter the flow pattern. If desired, each tube could be provided with a flow meter. It will be appreciated that the use of these variables will be determined primarily upon the profile of the extrusion being made and the desired rate of cooling for each section. For example, more water would be required to provide a given amount of cooling on a wall portion that has a greater thickness than another wall portion. Similarly, uniform cooling throughout the extrusion will contribute to the extrusion remaining straight in its axial direction. If desired, however, variations in cooling may be employed in order to cause the extrusion to assume an arched configuration as it moves from the quench unit 6.

Another feature of the invention is that tube 82 maybe rotated axially so as to provide the nozzle discharge direction with a different orientation. This may be accomplished by manually rotating tube 82 which has its ends rotatably journalized in coupling 124 and bushing 126. Set screw means 127 passing through coupling 124 may be employed to lock tube 82 in the desired angular position. If desired, motor means for automatically effecting such axial rotation of the tubes may be provided.

Referring once again to FIG. 2 and 3, the tubes 76, 78, 80, 82 have respectively individual transducers 130, 132, 134,136, 138, respectively. These pipes have individual valves 140, 142, 144, 146, 148, respectively. The other tubes will also be provided with transducers and valves in a similar manner.

Another feature of the invention shown in FIGS. 2 and 3 is an optical pyrometer 160 which measures the temperature of the extrusion 4 as it enters the quenching unit. It provides this information to a controller by an electrical wire (not shown). As the controls and wiring therefor form no part of the invention per se, and would be well known to those skilled in the art, these have not been illustrated. By knowing the incoming extrusion temperature, one can determine whether the carriage 6 has been placed in the proper position to achieve the desired rate of air cooling and the desired entry temperature to obtain the desired entry temperature prior to the extrusion entering the quench unit.

If desired, the optical pyrometer 160 may be coupled to a closed loop feedback system to automatically position the quench unit carriage 6 at a distance D (FIG. 1) that will provide the desired extrusion inlet temperature as it enters quenching unit 6. Also, it may serve to cause movement of the carriage toward the extrusion press 2 when extrusion is stopped in order to achieve proper quenching and minimize scrap.

Figure 10:
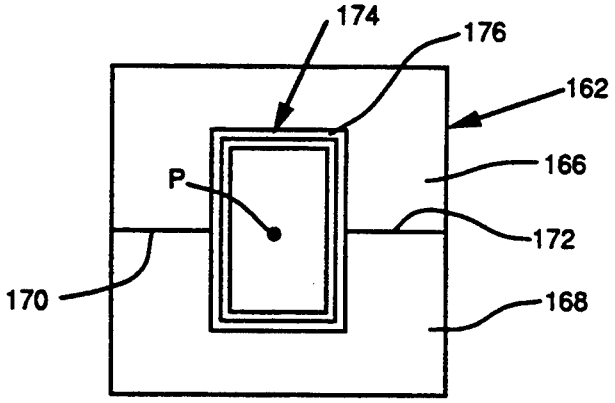
FIG. 10 is an illustration of a guide means and an extrusion position therein.

Referring to FIGS. 2, 3, 4 and 10, a further preferred feature of the invention will be considered. As has been indicated hereinbefore, it is desired that the path P (FIG. 5) of the extrusion through the quenching unit 6 be substantially centrally positioned with respect to the cooling liquid delivery tubes 72, 74, 76, 78, 80, 82, 84, 86, 88, 90, 92. It is important that the extrusion be confined to the desired path P. For this purpose, an entry guide 162 and an exit guide 164 each having an opening corresponding to the outer periphery of the extrusion 4 are positioned along path P. As shown in FIG. 10, the entry guide 162 consists of an upper portion 166 and a lower portion 168 which meet as adjacent surfaces 170, 172. Passing through the entry guide 162 is a generally rectangular tubular extrusion 174 which is of generally identical shape as the opening 176 in guide 162 but of slightly smaller size. In this manner, the extrusion 174 is confined to the desired path P as it moves through the quenching unit 6. The opening 180 for receipt of entry guide 162 is shown in FIG. 4. It is preferred that the guides 162, 164 be made of carbon block or other suitable heat resistant, low friction material.

It will be noted that in the form shown an end wall 182 defines the opening in the entry end of the quench unit 6. A similar construction, but without the presence of optical pyrometer 162 (not shown) is provided at the exit end. If it is desired to assist in quench parameter setup and adjustment, a pyrometer may be provided at the quench unit exit in a similar manner as the entry pyrometer 160.

Figure 6:
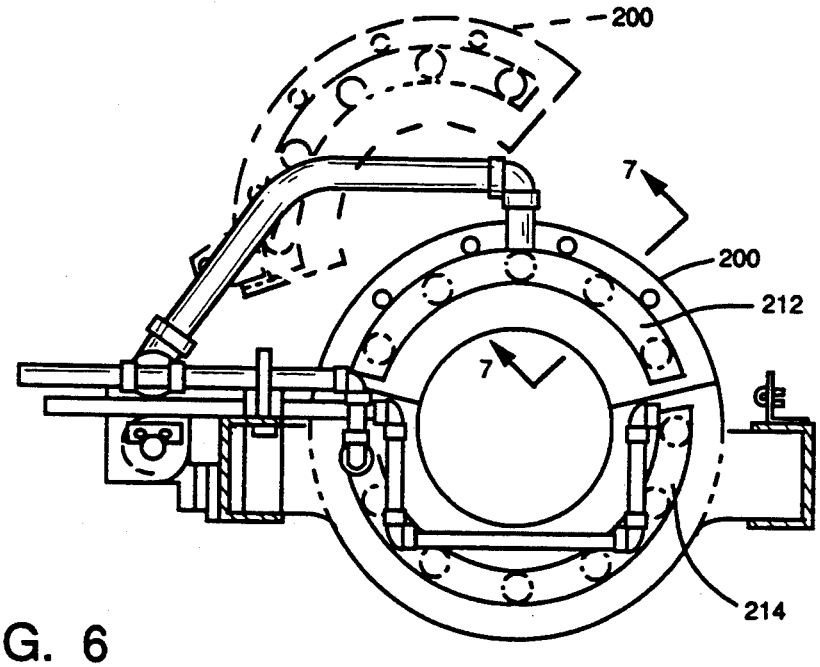
FIG. 6 is a cross-sectional illustration of the apparatus of FIG. 2 taken through 6—6.

Referring to FIGS. 5 and 6 a further feature of the invention will be considered. The carriage unit 6 has a generally downwardly concave upper section 200 and a generally upwardly concave lower section 202. In a preferred embodiment, the upper section 200 is pivotally mounted about pivot member 206 and by means of actuator 208 is upwardly rotatable with respect to the stationary lower housing section 202 with the split line between the two occurring at 210. The quench upper unit 200 in its open position is shown in phantom in FIG. 5. This opening permits access to the tubes and nozzles for adjustment, maintenance and repair. This opening also facilitates initial manual guiding of the extrusion 4 on path 7 through the guide blocks 162, 164.

If desired, in lieu of a hinged connection between upper section 200 and lower section 202, the upper section 200 may be subjected to upward and downward translational movement to respectively assume open and closed positions. Suitable power means to effect desired movement and track means to define the path of upper section movement would be provided.

In FIG. 6, the pipes connected to the upper header 212 and the lower header 214 are shown. The upper portion is shown in its open position in phantom. As is true with a number of the hose connections of the present invention, flexible tubing is employed in part so as to permit the degree of movement desired whether the movement be the opening of the upper housing portion 200 or quench unit carriage movement while maintaining continuous contact with reservoir 12 and air supply means 22, for example.

Referring again to FIG. 7, a further feature of the present invention will be considered. A significant portion of the upper housings preferably takes the form of a clear plastic window 220 which may be made of Plexiglas so as to permit viewing of the equipment during operations.

Figure 8:
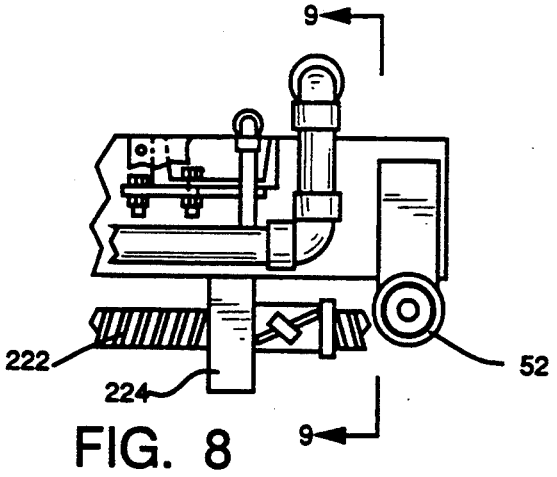
FIG. 8 is a cross-sectional illustration taken through 8—8 of FIG. 2.
Figure 9:
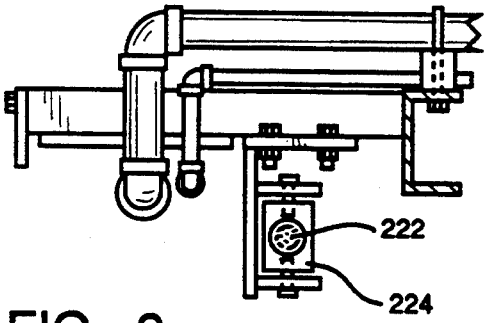
FIG. 9 is a cross-sectional illustration taken through 9—9 of FIG. 8.

As shown in FIGS. 8 and 9, the carriage which is supported by the wheels 50, 52, 54, 58 is moved in a reciprocating longitudinal direction along tracks 8, 10 by means of a ball screw 222 and an associated retainer 224. The ball screw 222 is rotated axially by a D.C. servomotor which is mounted on the side of the quench unit carriage 6. The motor, therefore, causes movement of the carriage 6 to the desired position with respect to the exit end of the extrusion press 2. If desired, other forms of power means may be employed to effect movement of the quench unit carriage 6. Also, if desired, the carriage could be suspended from an overhead track.

If desired, control means in the form of a microprocessor could be employed to position the quench unit carriage 6 the desired distance D (FIG. 1) from the extrusion press 2 responsive to the temperature reading obtained by entry optical pyrometer 160.

While with respect to both solid and tubular extrusions, the desired amount of cooling water impingement on particular regions may be determined in order to maintain the uniformity of profile throughout the axial extent of the extrusion and resist undesired departures from axial straightness of the extrusion, if desired differential cooling may be employed to create a part which departs from an axial straight position. For example, if a hollow generally rectangular extrusion of this sort shown in FIG. 10 were subjected to more cooling on the right vertical side than on the left, the extrusion would emerge from the quenching unit with a concave bow which faces the left. Also, if it is desired to modify the cross-sectional shape to create a different profile from that emerging from the extrusion press 2, this can be done within reasonable limits. As a result, not only can the flexibility of the present invention produce uniformity of cooling regardless of variations in cross-sectional contour and wall thickness of the extrusion, but it also can create designed departures from straightness and original cross section where desired.

Figure 11:
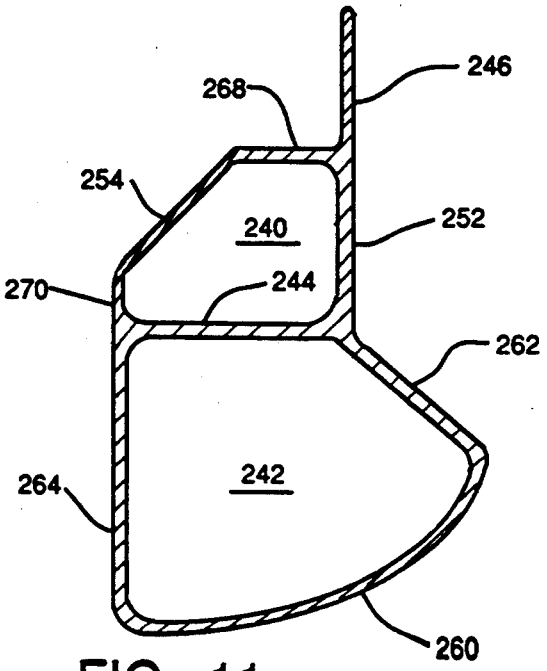
FIG. 11 is a cross-sectional illustration of an example of an extrusion which may be cooled efficiently by the present invention.

Referring to FIG. 11, an example of the cross section of a metal extrusion which may benefit from the customized cooling of the present invention is shown. The extrusion has two hollow regions 240, 242 and an interior wall 244 separating them. A fin 246 projects upwardly from the upper portion of the extrusion. Walls 252, 254, 268 and 270 cooperate with wall 244 to define recess 240. Walls 260, 262 and 264 cooperate with wall 244 to define recess 242. It will be noted what some walls differ from others in thickness, contour, length and orientation. For example, wall 252 is much thicker than wall 254 and has a different orientation. Knowing these variables, one may employ the system of the present invention to effect efficient cooling of the extrusion. For example, to achieve equal cooling, wall 252 would require a greater volume of cooling liquid than 254.

It will be appreciated that the method of the present invention involves in its preferred form, initial air cooling to cause the extrusion at the point of entry of the quenching unit to be at a desired temperature. By establishing the flow rate and related pressure of the cooling fluid within each tube and adjusted each nozzle as to volume of output and direction and pattern of spray, efficient cooling of the extrusion as it passes through the stationary cooling quenching unit is achieved. Also, if desired an axial segment of the nozzles on all or some of the tubes may be turned off to reduce the axial extent of the cooling zone.

While the invention is not limited to any particular aluminum alloys, it has been found advantageous to employ the apparatus for the in-line solution heat treating of the 2xxx, 6xxx and some 7xxx alloys. The invention is also useful in the product to minimize undesired hot handling marks.

In general, the extrusion will preferably enter the quench unit 6 after air cooling at a temperature at about the solvus temperature and will be cooled in the quench unit to less than about 300° F. The inlet and outlet temperatures of the extrusion are preferably about 935°–985° F. at entry and about 70°–300° F. at exit. Quenching of a given section of an extrusion will generally be accomplished within less than about 60 seconds at a metal mass flow rate of up to about 80 pounds or more per minute. The cooling chamber is preferably about 100 to 250 inches from the exit end of the extrusion press. (This distance is shown as D in FIG. 1).

The extrusion press may extrude at such a rate that the linear movement of the extrusion will be about 10 to 100 feet per minute. Movement of the carriage 6 also facilitates access to the tool carriage of the extrusion press and shearing of the extrusion butt.

It will be appreciated from the foregoing that the present invention provides an apparatus and method for effectively cooling metal extrusions, such as aluminum extrusions, in a highly efficient manner through a combination of adjustability features including, but not limited to positioning of the quench unit a predetermined distance from the extrusion die exit so as to facilitate the degree of air cooling desired, control of water flow and pressure to the individual cooling liquid delivery tubes, individual adjustment of the spray nozzles on each tube to facilitate the volume, pattern and direction of delivery along with the axial rotation of the tubes. This provides the ability to establish a custom cooling setup for any extruded shape. By minimizing thermal gradients within the extrusion, undesired distortion is resisted. All of this is accomplished in an efficient rapid manner which is compatible with production speeds on aluminum extrusion presses.

While for purposes of illustration herein, emphasis has been placed upon a preferred use of the invention in quenching aluminum extrusions, the invention is not so limited. It may be employed in quenching other metal extrusions composed of press quenchable metal, such as those made of magnesium or steel, for example.

Whereas particular embodiments of the invention have been described hereinbefore for purposes of illustration, it will be evident to those skilled in the art that numerous variations of the details may be made without departing from the invention as defined in the appended claims.

We claim:

1. A method of quenching a metal extrusion comprising providing a housing containing an array of cooling liquid delivery tubes each having a plurality of nozzles with said tubes being oriented generally parallel to the path of travel of said extrusion and said nozzles within each said generally parallel oriented tube being relatively spaced from each other, establishing flow of said cooling liquid within said tubes in a direction generally parallel to said path of extrusion travel while effecting discharge of said cooling liquid from said nozzles, establishing the magnitude and direction of cooling liquid flow out of said nozzles on the basis of the profile of said extrusion, passing said extrusion through said housing such that said extrusion sequentially passes by each of said plurality of nozzles on each said tube, and delivering cooling liquid from said nozzles to said extrusion as the extrusion passes therethrough.

2. The method of claim 1 including effecting delivery of a different volume of cooling liquid from some nozzles than from others.

3. The method of claim 2 including monitoring the temperature of said extrusion as it enters said housing, and effecting said cooling to reduce the temperature of said extrusion from at least the solvus temperature to less than about 300° F.

4. The method of claim 2 including effecting said cooling so as to cool some portions of said extrusion more rapidly than other portions.

5. The method of claim 2 including maintaining said extrusion in a substantially straight axial configuration as it exits the housing.

6. The method of claim 4 including altering the configuration of said extrusion by said cooling.

7. The method of claim 2 including employing water as said cooling liquid.

8. The method of claim 1 including air cooling said extrusion prior to introducing said extrusion into said housing.

9. The method of claim 8 including prior to introducing said extrusion into said housing moving said housing to a predetermined distance from the extrusion press, whereby said extrusion will be cooled to the desired temperature before entering said housing, and maintaining said housing substantially stationary during said cooling of said extrusion.

10. The method of claim 1 including effecting axial rotation of at least one of said liquid delivery tubes to alter the direction of cooling liquid flow.

* * * * *